United States Patent [19]

Ottmann et al.

[11] Patent Number: 4,890,556

[45] Date of Patent: Jan. 2, 1990

[54] AMMUNITION HOUSING

[75] Inventors: Roland Ottmann, Neunkirchen/S.; Wolfgang von Entress-Fursteneck, Leinburg, both of Fed. Rep. of Germany

[73] Assignee: Diehl GmbH & Co., Nuremberg, Fed. Rep. of Germany

[21] Appl. No.: 234,406

[22] Filed: Aug. 19, 1988

[30] Foreign Application Priority Data

Sep. 15, 1987 [DE] Fed. Rep. of Germany ... 8712460[U]

[51] Int. Cl.[4] ..... F42B 13/12

[52] U.S. Cl. ..... 102/499; 102/221; 102/473

[58] Field of Search ..... 102/221, 293, 401, 473, 102/476, 487, 488, 499, 500, 416, 419

[56] References Cited

U.S. PATENT DOCUMENTS

| | | | |
|---|---|---|---|
| 1,339,735 | 5/1920 | Bergman | 102/476 |
| 2,386,834 | 10/1945 | Barnum et al. | 102/476 |
| 2,644,399 | 7/1953 | Knowlton | 102/476 |
| 4,135,451 | 1/1979 | Rusbach | 102/64 |
| 4,809,613 | 3/1989 | von Entress-Fursteneck et al. | 102/476 |

*Primary Examiner*—Harold J. Tudor

*Attorney, Agent, or Firm*—Scully, Scott, Murphy & Presser

[57] ABSTRACT

An ammunition housing or casing including a cover portion for the closing off of an explosives chamber, and which includes a booster charge and a mechanical safe-and-arm device. The cover portion is constituted of a cover plate and a bracket unit which is integrally formed thereon, on which bracket unit there is provided a clamping device opposite the cover plate, wherein the closure plate is provided with a cutout or breakthrough which is overlapped by the bracket unit, which forms a receiving space for the booster charge, and wherein the mechanical safe-and-arm device is installed beneath the bracket unit, and the safe-and-arm device is pressed against the cover plate by the clamping device.

5 Claims, 1 Drawing Sheet

AMMUNITION HOUSING

BACKGROUND OF THE INVENTION

1. Field of the Invention

The present invention relates to an ammunition housing or casing including a cover portion for the closing off of an explosives chamber, and which includes a booster charge and a mechanical safe-and-arm device.

2. Discussion of the Prior Art

In known ammunition housings of that type, additional mounting components for the booster charge and the safe-and-arm device. In this case, the installation space which is required becomes comparatively large in size.

SUMMARY OF THE INVENTION

Accordingly, it is an object of the present invention to provide for an ammunition housing or casing of the above-mentioned type in which, on the cover portion itself which forms the closure for the explosives chamber, there are secured in position both the safe-and-arm device and the booster charge.

Inventively, the foregoing object is attained in that the cover portion is constituted of a cover or closure plate and a bracket unit which is integrally formed thereon, on which bracket unit there is provided a clamping device on the side opposite the cover plate, wherein the closure plate is provided with a cutout or breakthrough which is overlapped by the bracket unit, which forms a receiving space for the booster charge, and wherein the mechanical safe-and-arm device is installed beneath the bracket unit, and the safe-and-arm device is pressed against the cover plate by the clamping device.

Through the foregoing there is attained that the cover part assumes a plurality of functions. On the one hand, it closes off the housing or casing by means of its cover plate. The cover plate ensures the presence of the necessary bending resistance or flexural strength for the housing in its base region. On the other hand, the cover plate concurrently forms the receiver for the booster charge. Moreover, the bracket unit of the cover plate is the receiver for the safe-and-arm device. As a result thereof, the latter is retained in a secure and positionally-correct manner in front of the booster charge on the cover plate.

Through these measures, the installation space which is required for this purpose is maintained relatively small in size.

Pursuant to a preferred embodiment of the invention, a receiving member for an electronic ignition or trigger circuit is attached on the bracket unit, wherein the member encompasses the safe-and-arm device and which is secured in position on the cover plate by means of the clamping device. Thereby, the clamping device of the cover part concurrently forms also the retention for the receiving member of the ignition circuit.

BRIEF DESCRIPTION OF THE DRAWINGS

Further advantageous embodiments and features of the invention can now be readily ascertained from the following detailed description of an exemplary embodiment thereof, taken in conjunction with the accompanying drawings; in which.

DETAILED DESCRIPTION

A cover part 1 is constituted from a cover or closure plate 2 and a bracket unit 3 which is integrally formed on the plate.

Figure 1:
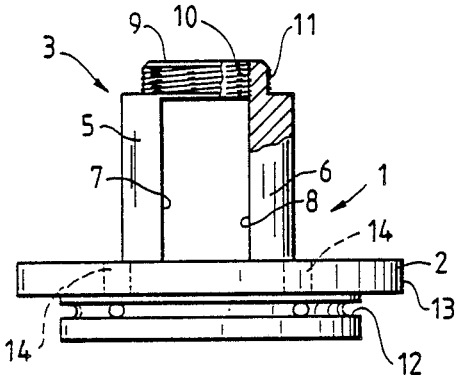
FIG. 1 illustrates a side elevational view, partly in section, of the cover part for the ammunition housing.
Figure 2:
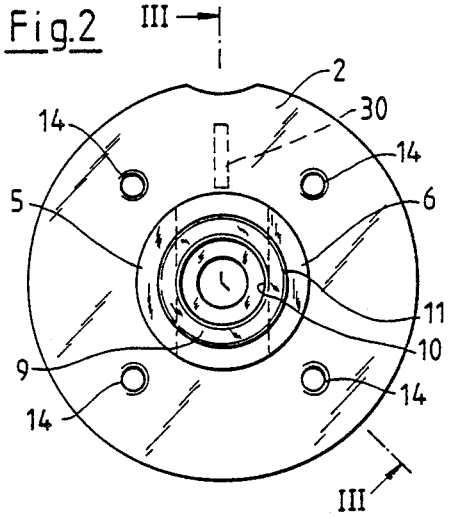
FIG. 2 illustrates a plan view of the cover part.
Figure 3:
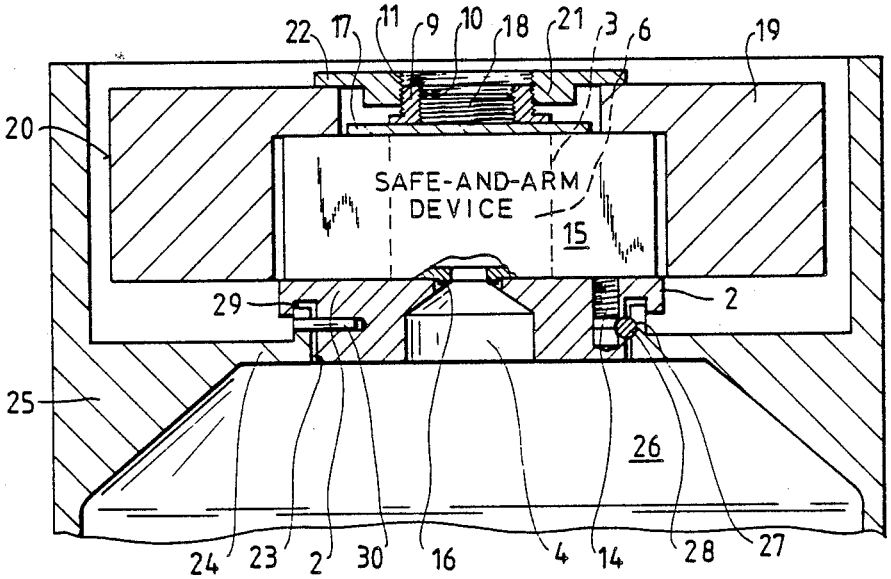
FIG. 3 illustrates, on an enlarged scale, a sectional view taken along line III—III in FIG. 2 with the assembled safe-and-arm device and receiving member for an ignition or trigger circuit.

In the center of the closure plate 2 there is formed a cutout or breakthrough 4 (as shown in FIG. 3). This cutout is dimensioned such that it forms the receiving space for a booster charge (not shown). The bracket unit 3 possesses two arms 5, 6, whose inner surfaces extend in a plane parallel relationship. At the ends thereof distant from and facing away from the closure plate 2, the arms 5, 6 are interconnected through a cross-member 9. The cross-member 9 possesses an internal screw thread 10 and an external screw thread 11.

The closure plate 2 is provided with an annular groove 12 extending about its outer circumference. A ledge 13 projects beyond this groove. In addition to the arms 5, 6, threaded bores 14 are formed in the closure plate 2, which bores connect with the annular groove 12.

Inserted between the arms 5, 6 is a mechanical safe-and-arm device 15 (as shown in FIG. 3), which is generally squarely shaped in its external dimensions. Hereby, this safe-and-arm device is positioned so as to be in close fit with the arms 5, 6 and between the cross-member 9 and the cutout 4. The mechanical safe-and-arm device 15 possesses a projection 16 with which it engages into the cutout 4 for orientation in the correct position.

Intermediate the safe-and-arm device 15 and the cross-member 9, a pressure plate 17 is inserted between the arms 5 and 6. A threaded bolt 18 is screwed into the internal screw thread 10 of the cross-member 9, by means of which bolt the pressure plate 17 is pressed against the safe-and-arm device 15 and, as a result thereof, the latter pressed against the closure plate 2.

Thereafter, a receiving member 19 is mounted over the bracket unit 3 or the safe-and-arm device 15. This member 19 encompasses the safe-and-arm device 15 and possesses a cylindrical outer wall 20. The receiving member 19 is equipped with chambers (not shown) in which there are arranged the components of an electronic trigger or ignition circuit. The receiving member 19 is secured in its position on the cover part 1 by means of a nut 21 possessing an external shoulder 22, and wherein the nut is screwed onto the outer thread 11 of the cross-member 9.

The closure plate 2 of the cover part 1 is inserted into an opening 23 which is provided in an intermediate partition 24 of the ammunition housing or casing 25. As a consequence thereof, it seals off the explosives chamber 26 of the ammunition housing 25.

The opening 23 is equipped with an annular groove 27 which corresponds or aligns with the annular groove 12 in the closure plate 2. A slit retainer ring 28 is inserted into the annular groove 12, which is spread apart in a manner for the secure positioning of the cover part 1 on the intermediate partition 24 by means of screws which are threaded into the threaded bores 14, so as to cause the retainer ring to engage into both aligned annular grooves 12, 27.

The ledge 13 projects over the opening 23. On the ledge there is formed an encompassing recess 29 into which there engages the intermediate partition 24.

In order to provide for an orientation in the correct installing position of the cover part 1 relative to the ammunition housing 25, a pin 30 is arranged on the closure plate 2, which engages into a complimentary or mating recess formed in the intermediate partition 24.

Through the provision of the closure plate 2 of the cover part 1 there is afforded a closure for the opening 23 in the intermediate partition 24 which serves for the pouring of the explosive material into the explosives chamber 26. The closure plate 2 ensures the presence of the bending resistance of flexural stiffness of the intermediate partition 24, and through the presence of its cutout or breakthrough 4 simultaneously forms the receiving space for the booster charge.

By means of the arms 5, 6 and the cross-member 9, there is made provision for a stable and positionally-correct fastening of the safe-and-arm device 15, whereby the internal screw thread 10, by means of the threaded bolt 18 and the pressure plate 17, forms the clamping device which is necessary for the secure positioning of the safe-and-arm device 15.

The external screw thread 11 of the cross-member 9, in conjunction with the nut 21, forms the portion of the clamping device through which the receiving member 19 can be fixed in position on the cover part 1.

As a result of the receiving member 19 encompassing the safe-and-arm device 15, the member utilizes space which is available within the ammunition housing or casing 25.

What is claimed is:

1. Ammunition housing including a cover part for the closure of an explosives chamber; a booster charge and a mechanical safe-and-arm device, said cover part comprising a closure plate having a central cutout receiving said booster charge, and bracket means integrally formed on said closure plate including a pair of spaced upstanding arm members straddling said cutout; a clamping device on said bracket means distant from said closure plate, said clamping device including a cross-member of said bracket means extending between and connecting the arm members, said cross-member having an internal screw thread and an external screw thread, said safe-and-arm device being positioned intermediate said arm members beneath said clamping device a threaded bolt being screwed into said internal screw thread for pressing the safe-and-arm device against the closure plate; a receiving member for an ignition circuit being mounted on and encompassing said safe-and-arm device; and a threaded nut engaging said external screw thread on said cross-member, said nut having an external shoulder for pressing said receiving member against said safe-and-arm device.

2. Ammunition housing as claimed in claim 1, wherein said arm members have planar parallel internal surfaces facing each other, said safe-and-arm device being positioned intermediate said surfaces.

3. Ammunition housing as claimed in claim 1, wherein said mechanical safe-and-arm device includes a projection engaging into said cutout in the closure plate.

4. Ammunition housing as claimed in claim 1, wherein said closure plate includes an annular groove; a split retainer ring being inserted into said groove; an opening in the ammunition housing having a further annular groove therein for matingly aligning with the groove in said closure plate; threaded bores in said closure plate intersecting the annular groove therein; and screws engageable in said threaded bores for spreading apart said retainer ring so as to cause said ring to engage into both said annular grooves.

5. Ammunition housing as claimed in claim 1, wherein said closure plate includes a ledge having an annular recess, said ammunition housing engaging into said recess.

* * * * *